US011256200B2

(12) United States Patent
Imada et al.

(10) Patent No.: US 11,256,200 B2
(45) Date of Patent: Feb. 22, 2022

(54) FIXING DEVICE, HEATING DEVICE, AND IMAGE FORMING DEVICE WITH A SUBSTRATE COVERING MEMBER COVERING A RELAY SUBSTRATE

(71) Applicant: Ricoh Company, Ltd., Tokyo (JP)

(72) Inventors: Takahiro Imada, Kanagawa (JP); Yoshio Hattori, Kanagawa (JP); Yoshikuni Sasaki, Kanagawa (JP); Hiromasa Takagi, Tokyo (JP); Yasunori Ishigaya, Kanagawa (JP); Takumi Waida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/147,894

(22) Filed: Jan. 13, 2021

(65) Prior Publication Data

US 2021/0223724 A1 Jul. 22, 2021

(30) Foreign Application Priority Data

Jan. 17, 2020 (JP) ..... JP2020-006094
Apr. 10, 2020 (JP) ..... JP2020-070856

(51) Int. Cl.
*G03G 15/00* (2006.01)
*G03G 15/20* (2006.01)
*G03G 21/16* (2006.01)

(52) U.S. Cl.
CPC ..... *G03G 15/2028* (2013.01); *G03G 21/1652* (2013.01); *G03G 21/1685* (2013.01)

(58) Field of Classification Search
CPC ..... G03G 15/2028; G03G 21/1652; G03G 21/1685
USPC ..... 399/90, 122, 322
See application file for complete search history.

(56) References Cited

U.S. PATENT DOCUMENTS 5,561,499 A * 10/1996 Setoriyama ..... G03G 21/1652 399/90
9,983,540 B2 * 5/2018 Kobayashi ..... G03G 21/1652
10,935,918 B2 * 3/2021 Iijima ..... G03G 15/6567
2020/0241452 A1 7/2020 Saitoh et al.
2020/0241453 A1 7/2020 Okamoto et al.

FOREIGN PATENT DOCUMENTS

JP 2010-072073 4/2010

* cited by examiner

*Primary Examiner* — William J Royer
(74) *Attorney, Agent, or Firm* — Xsensus LLP

(57) ABSTRACT

A fixing device is configured to be detachably attached to an image forming device main body. The fixing device includes a fixing member, a heating source, a pressing member, a conveyance guide member, an exterior member, a relay substrate, and a substrate covering member. The fixing member is configured to heat a toner image so as to fix the toner image on a recording medium. The heating source is configured to heat the fixing member. The pressing member is configured to press against the fixing member to form a nip part. The conveyance guide member is configured to guide the recording medium to the nip part. The exterior member houses at least the fixing member and the pressing member. The substrate covering member covers the relay substrate. The substrate covering member extends from and is integrated with the conveyance guide member.

12 Claims, 8 Drawing Sheets

FIXING DEVICE, HEATING DEVICE, AND IMAGE FORMING DEVICE WITH A SUBSTRATE COVERING MEMBER COVERING A RELAY SUBSTRATE

CROSS-REFERENCE TO RELATED APPLICATIONS

The present application claims priority under 35 U.S.C. § 119 to Japanese Patent Application No. 2020-006094, filed on Jan. 17, 2020, and Japanese Patent Application No. 2020-070856, filed on Apr. 10, 2020. The contents of which are incorporated herein by reference in their entirety.

BACKGROUND OF THE INVENTION

1. Field of the Invention

The present invention relates to a fixing device, a heating device, and an image forming device.

2. Description of the Related Art

In an image forming device including a fixing device, it is necessary to attach or detach the fixing device to or from an image forming device main body in order to deal with paper jam, maintain components in the fixing device, or exchange the fixing device. Since the fixing device includes a heating source (for example, halogen heater), a temperature detection member, a set detection member for detecting the presence or absence of the fixing device, and the like, electric connection for power supply from the image forming device main body to the heating source or transmission of a temperature detection signal is necessary. In view of this, a drawer connector that can easily connect or disconnect between the fixing device and the image forming device main body when the fixing device is attached to or detached from the image forming device main body has been known. The drawer connector is an electric contact point to the image forming device main body for supplying power to an electric system of the heating source, a temperature detecting member, or the like in the fixing device.

In the detachable fixing device including the drawer connector for connecting a lead wire (signal wire) of a temperature detecting means of the fixing device to the image forming device main body, when the fixing device is attached or detached, a terminal part of the drawer connector slides and due to this sliding, gold plating on a surface layer of a terminal falls. As a result, nickel plating in a lower layer is exposed. Since this nickel plating exists near the fixing device, the nickel plating is exposed to a high-temperature and high-humidity environment, and accordingly, nickel oxide is generated. Thus, contact failure occurs in a contact point part and as a result, a temperature detection signal is not transmitted properly and various troubles occur. The behavior at the contact point part when the contact failure occurs because of the nickel oxide is very instable and a contact resistance changes suddenly or a resistance value becomes intermediate. In most cases, however, a resistance increase does not last and due to small vibration, or attachment or detachment of the fixing device, the state returns to a normal state.

FIG. 6 in Japanese Unexamined Patent Application Publication No. 2010-72073 discloses a drawer connector including a male connector and a female connector, in which the male connector is in contact with the female connector at two contact point parts on upper and lower sides. This drawer connector includes two contact point parts for each one signal; however, for solving the problem, a special drawer connector needs to be manufactured.

However, the connector with a special specification is not versatile and a connector that suits the device specification cannot be employed. For example, in a case where a necessary number of signal lines or power source lines are not prepared and the use is limited, or on the contrary, where more than necessary signal lines or power source lines exist, the size or the like is restricted.

On the other hand, a structure in which, when the contact failure occurs at the contact point of the connector that connects the lead wire of the temperature detecting means of the detachable fixing device to the image forming device main body, the temperature detection signal is similarly transmitted properly and the resulting trouble is prevented has been suggested.

On the other hand, the lead wire connected to the connector is relayed by a substrate in the fixing device.

As described above, even if the contact failure at the contact point of the connector is solved, an operation failure caused by the substrate for relaying (hereinafter referred to as "relay substrate") may occur.

Even though the fixing member has a predetermined temperature at a cold start of the fixing device (for example, when the power is supplied or the device is restored from a standby mode), a water droplet (dew) may adhere to a surface of a peripheral member that is not warmed sufficiently yet.

A region to house the relay substrate is present on the exterior side of the fixing device, and a steam component generated by paper feeding flows in through a space for connector connection, for example, and dew may condense on the substrate. Such dew condensation on the substrate may cause the operation failure.

SUMMARY OF THE INVENTION

A fixing device is configured to be detachably attached to an image forming device main body. The fixing device includes a fixing member, a heating source, a pressing member, a conveyance guide member, an exterior member, a relay substrate, and a substrate covering member. The fixing member is configured to heat a toner image so as to fix the toner image on a recording medium. The heating source is configured to heat the fixing member. The pressing member is configured to press against the fixing member to form a nip part. The conveyance guide member is configured to guide the recording medium to the nip part. The exterior member houses at least the fixing member and the pressing member. The substrate covering member covers the relay substrate. The substrate covering member extends from and is integrated with the conveyance guide member.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
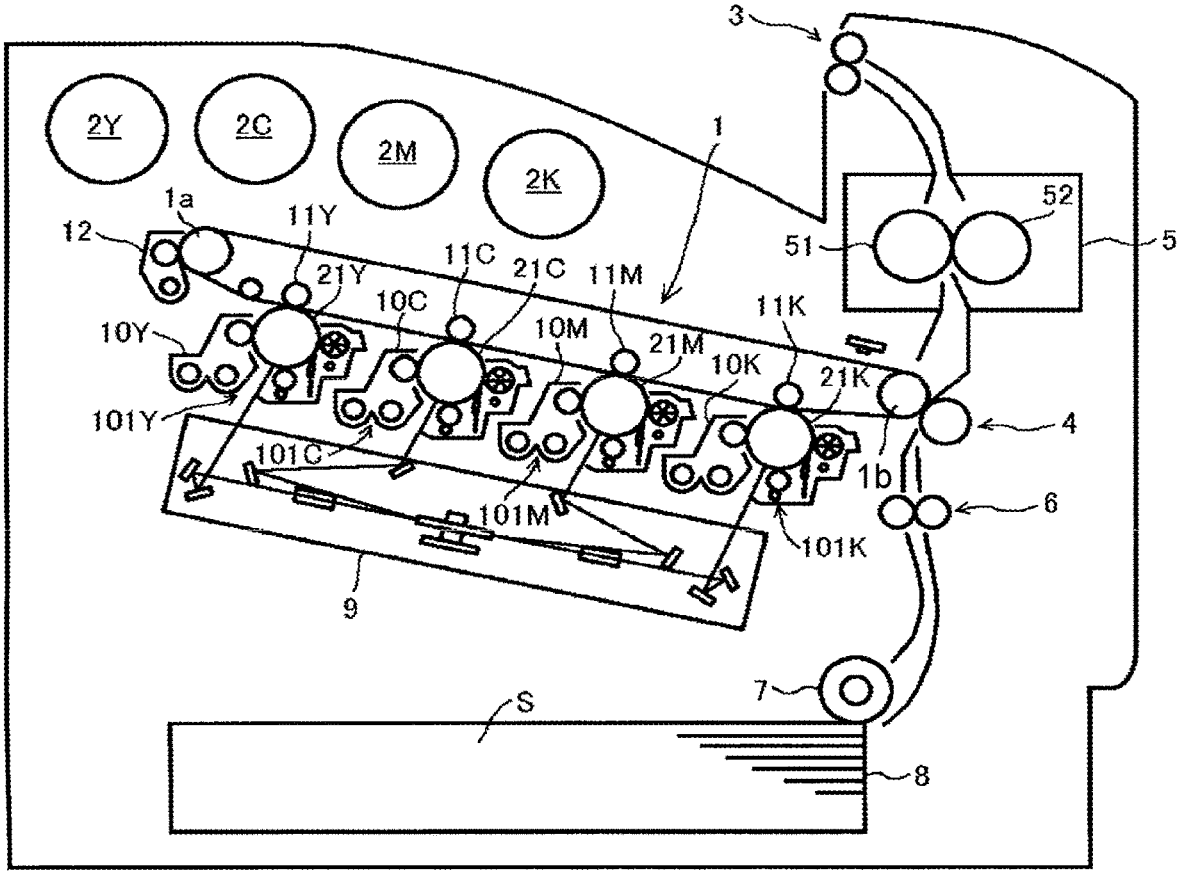
FIG. 1 is a schematic structure diagram of an image forming device according to one embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to provide a fixing device in which adhesion of dew on the relay substrate can be prevented and the occurrence of a trouble in the signal transmission can be prevented.

A fixing device, a heating device, and an image forming device according to the present invention are hereinafter described in detail with reference to the drawings. Note that the present invention is not limited to embodiments below, and changes such as other embodiments, addition, correction, and deletion are possible within the range where the person skilled in the art can conceive and all the modes are included in the scope of the present invention as long as the effect and operation of the present invention are obtained.

Image Forming Device

An electrophotography color laser printer (hereinafter also simply referred to as "printer") as an image forming device according to an embodiment of the present invention is hereinafter described.

FIG. 1 is a schematic structure diagram of the printer according to the present embodiment. In this printer, four image forming means of yellow, cyan, magenta, and black are arranged side by side to form a tandem image forming unit. In the tandem image forming unit, image forming means 101Y, 101C, 101M, and 101K that are individual toner image forming means are disposed in this order from the left in the drawing. Here, the alphabets Y, C, M, and K added to the respective numerals represent members for yellow, cyan, magenta, and black, respectively. In the tandem image forming unit, the individual image forming means 101Y, 101C, 101M, and 101K include charging devices, developing devices 10Y, 10C, 10M, and 10K photoconductor cleaning devices, and the like around drum-shaped photoconductors 21Y, 21C, 21M, and 21K corresponding to image bearers. In an upper part of the printer, toner bottles 2Y, 2C, 2M, and 2K filled with yellow, cyan, magenta, and black toners, respectively are provided. A predetermined amount of toner with the respective colors is supplied from these toner bottles 2Y, 2C, 2M, and 2K to the developing devices 10Y, 10C, 10M, and 10K for the respective colors along a conveyance route included in the image forming device.

In addition, an optical writing unit 9 is provided as a latent image forming means below the tandem image forming unit. This optical writing unit 9 includes a light source, a polygon mirror, an f-θ lens, a reflection mirror, and the like, and is configured to deliver laser light while scanning on a surface of each photoconductor 21 on the basis of image data.

Right over the tandem image forming unit, an intermediate transfer belt 1 with an endless belt shape is provided as an intermediate transfer body. This intermediate transfer belt 1 is extended between supporting rollers 1*a* and 1*b*, and to a rotation shaft of the supporting roller (driving roller) 1*a* of these supporting rollers, a driving motor as a driving source is connected. Driving this driving motor causes the intermediate transfer belt 1 to rotate and move counterclockwise in the drawing, and rotates the supporting roller 1*b* that can be driven. Inside the intermediate transfer belt 1, primary transfer devices 11Y, G-M 11C, 11M, and 11K for transferring the toner images formed on the photoconductors 21Y, 21C, 21M, and 21K onto the intermediate transfer belt 1 are provided.

In addition, a secondary transfer roller 4 is provided as a secondary transfer device on the downstream side in the driving direction of the intermediate transfer belt 1 relative to the primary transfer devices 11Y, 11C, 11M, and 11K. On the side opposite to this secondary transfer roller 4 with the intermediate transfer belt 1 interposed therebetween, the supporting roller 1*b* is disposed and functions as a pressing member. In addition, a paper feeding cassette 8, a paper feeding roller 7, and registration rollers 6 are provided. Furthermore, on the downstream part of the secondary transfer roller 4 regarding an advancing direction of a recording medium S on which the toner image has been transferred by the secondary transfer roller 4, a fixing device 5 that fixes the image on the recording medium S and paper ejection rollers 3 are provided.

Next, an operation of the printer is described. By the individual image forming means, the photoconductors 21Y, 21M, and 21K are rotated and with the rotation of the photoconductors 21Y, 21C, 21M, and 21K, surfaces of the photoconductors 21Y, 21C. 21M, and 21K are uniformly charged with charging devices. Next, the image data is delivered with writing light of laser from the optical writing unit 9, so that electrostatic latent images are formed on the photoconductors 21Y, 21C. 21M, and 21K. After that, toner is attached by the developing devices 10Y, 10C, 10M, and 10K and the electrostatic latent images are made visible, so that monochromatic images of yellow, cyan, magenta, and black colors are formed respectively on the photoconductors 21Y, 21C. 21M, and 21K. The driving roller 1*a* is driven to rotate by the driving motor in the image forming device, so that the supporting roller 1*b* and the secondary transfer roller 4 are driven to rotate. Then, the intermediate transfer belt 1 is conveyed by rotation, so that the visible images are sequentially transferred onto the intermediate transfer belt 1 by the primary transfer devices 11Y, 11C. 11M, and 11K. Thus, a combined color image is formed on the intermediate transfer belt 1. The surfaces of the photoconductors 21Y, 21C, 21M, and 21K after the image transfer are cleaned by photoconductor cleaning devices so that the remaining toner is removed from the surfaces, and thus the photoconductors 21Y, 21C. 21M, and 21K are prepared for another image formation.

In accordance with the timing of the image formation, an end of the recording medium S is fed from the paper feeding cassette 8 by the paper feeding roller 7 and the recording medium S is conveyed to the registration rollers 6, and then, the recording medium S is stopped once. In synchronization with the timing of the aforementioned image forming operation, the recording medium S is conveyed between the secondary transfer roller 4 and the intermediate transfer belt 1. Here, the intermediate transfer belt 1 and the secondary transfer roller 4 form a so-called secondary transfer nip with the recording medium S interposed therebetween, and at the secondary transfer roller 4, the toner image on the intermediate transfer belt 1 is secondarily transferred onto the recording medium S.

The recording medium S after the image transfer is sent to the fixing device 5 where a nip part is formed by a fixing member 51 with a surface kept at predetermined temperature and a pressing member 52 that faces the fixing member 51 and is pressed against the fixing member 51. As the nip part holds and conveys the recording medium S, the toner image on the recording medium S is heated and pressed, so that the toner image is fixed on the recording medium S. After the recording medium S ejected from the nip part is separated by a separating member, the recording medium S is ejected out of the machine by the paper ejection rollers 3. On the other hand, the intermediate transfer belt 1 after the image transfer passes an intermediate transfer belt cleaning device 12 where the residual toner remaining on the intermediate transfer belt 1 after the image transfer is removed, and then, the intermediate transfer belt 1 is prepared for another image formation in the tandem image forming unit.

Fixing Device

Figure 9:
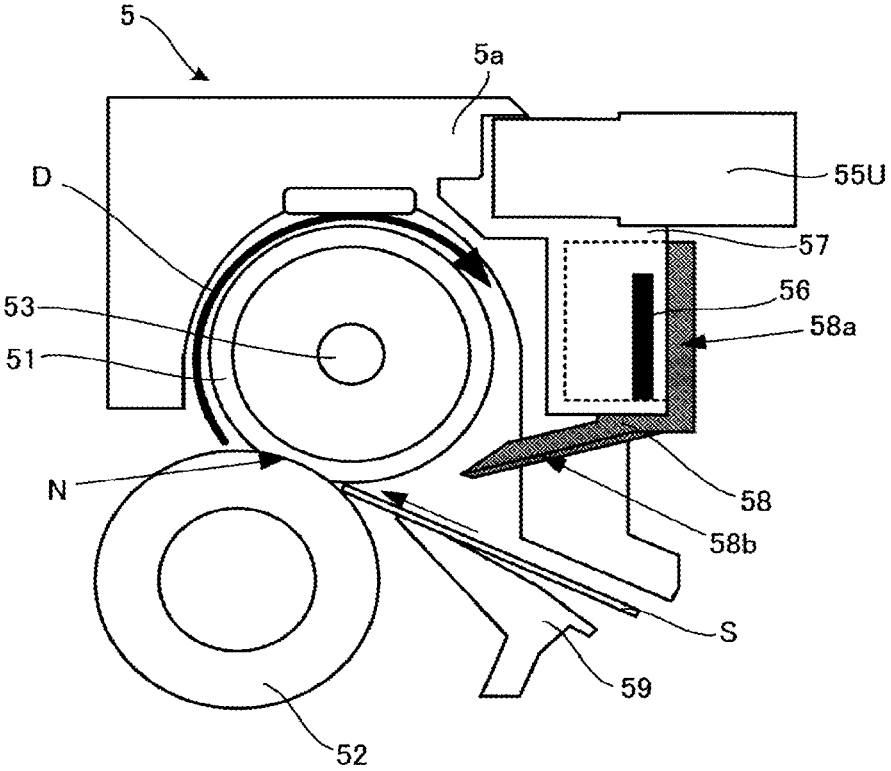
FIG. 9 is a cross-sectional view illustrating a main part structure of the fixing device according to the embodiment.
Figure 10:
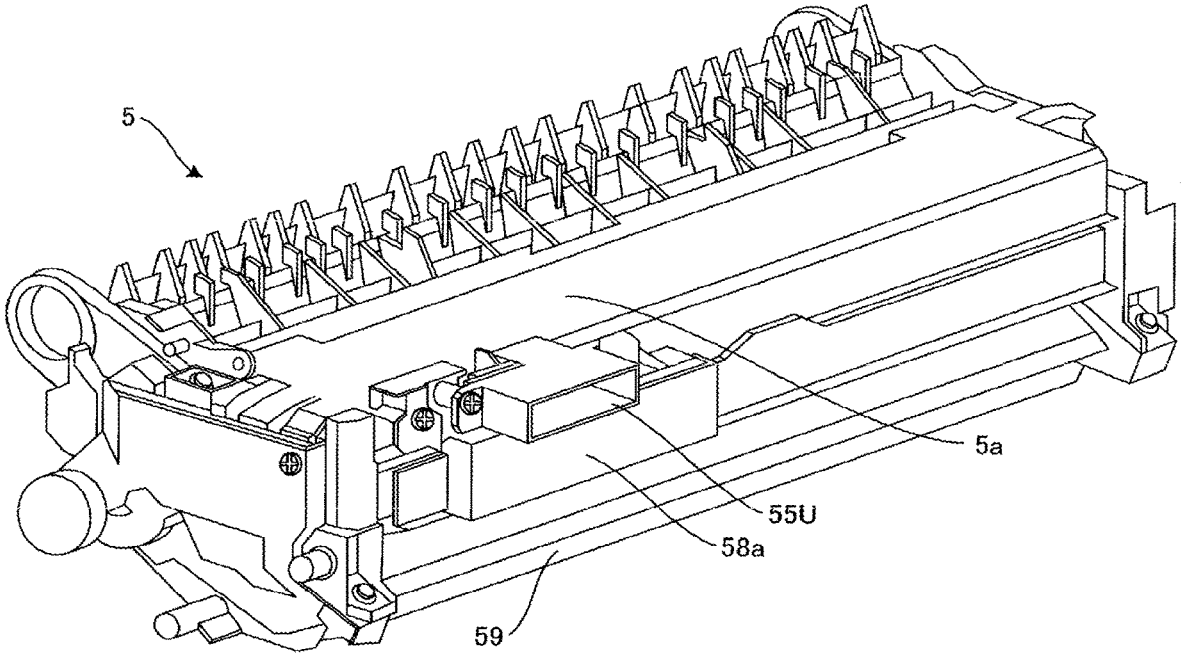
FIG. 10 is a perspective view illustrating an external appearance of the fixing device according to the embodiment.

FIG. 9 is a cross-sectional view and FIG. 10 is an external perspective view, both illustrating a main part structure of the fixing device 5 according to the embodiment of the present invention.

The fixing device 5 according to the present embodiment is a fixing device detachably attached to the image forming device main body and includes: the fixing member 51, a heating source 53 that heats the fixing member 51, the pressing member 52 that forms a nip part N by pressing against the fixing member 51, a conveyance guide member (upper guide 58 and lower guide 59) that guides the recording medium S to the nip part N, an exterior member 5*a* for housing at least the fixing member 51 and the pressing member 52, a relay substrate 56, and a substrate covering member 58*a* that covers the relay substrate 56. The substrate covering member 58*a* extends from and is integrated with the conveyance guide member (upper guide) 58.

The fixing device 5 according to the present embodiment is the fixing device that is detachably attached to the image forming device main body, and includes the fixing member 51, the heating source 53 that heats the fixing member 51, the pressing member 52 that forms the nip part N by pressing against the fixing member 51, the relay substrate 56, and the substrate covering member 58*a* that covers the relay substrate 56. The substrate covering member 58*a* includes a protruding part 58*b* that extends in a direction toward the pressing member 52.

As illustrated in FIG. 9, when the recording medium (hereinafter also referred to as "paper") S has advanced into the nip part N, water in the paper evaporates due to heating, so that steam is generated at an exit of the nip part N. Some of this steam flows in a direction indicated by an arrow D in the drawing.

The exterior member 5*a* of the fixing device 5 includes a plurality of gaps through which the steam flows in, for example, an opening for detecting the temperature of the fixing member 51 with a noncontact temperature sensor from the image forming device main body side or an opening shape that is necessary in molding the exterior member 5*a*.

Outside the fixing device (image forming device main body side or outer side surface of exterior member 5*a*), the temperature is lower than on the inside; thus, the incoming steam may condensate to form dew.

By contrast, in the fixing device 5 according to the present embodiment, the substrate covering member 58*a* extends from and is integrated with the conveyance guide member (upper guide) 58. The conveyance guide member (upper guide) 58 includes the protruding part 58*b* as the conveyance guide part that guides the recording medium S.

In the fixing device 5 in the present embodiment, the substrate covering member 58*a* includes the protruding part 58*b* that extends in the direction toward the pressing member 52.

Therefore, when the protruding part 58*b* is heated by the heat radiated from the fixing member 51, the temperature of the substrate covering member 58*a* that is formed integrally also increases. Thus, the temperature around the relay substrate 56 increases, and the dew condensation on the surface of the relay substrate 56 is prevented and the trouble caused by the adhesion of dew can be prevented.

The conveyance guide member (upper guide) 58 is a member that is heated by the heat radiated from the fixing member 51 heated by the heating source 53.

When the conveyance guide member (upper guide) 58 is quickly heated, the peripheral temperature around the substrate covering member 58*a* also increases quickly, and the effect of preventing the dew condensation on the relay substrate 56 is improved.

Accordingly, it is preferable that the conveyance guide member 58 is formed of at least one of a material with higher thermal conductivity and a material with smaller specific heat than the exterior member 5*a*.

In particular, a preferable material of the substrate covering member 58*a* is metal such as SUS or copper with high thermal conductivity from the viewpoint of the effect of preventing the dew condensation on the relay substrate 56, and is resin (for example, PET) from the viewpoint of weight reduction.

In the present embodiment, the conveyance guide member (upper guide 58 and lower guide 59) is formed of PET.

On the other hand, it is preferable that the exterior member 5*a* of the fixing device 5 in the present embodiment is formed of a material with high heat resistance and high rigidity.

In the present embodiment, the material of the exterior member 5*a* is LCP resin.

In the fixing device 5 according to the present embodiment, the relay substrate 56 is covered with the substrate covering member 58*a*, thereby preventing an operator or a service person from unintentionally touching the relay substrate 56 in the fixing device 5 that is put outside the device in the attachment or detachment of the fixing device 5. Thus, mechanical damage, electric damage due to static electricity, connector removal, or other troubles of the components can be prevented.

In the fixing device 5 according to the present embodiment, the exterior member 5*a* includes a drawer connector (fixing device side connector) 55U that transmits a signal to the image forming device by contact between terminals, and the relay substrate 56 is connected to the drawer connector 55U through a lead wire that transmits the signal.

Figure 11A:
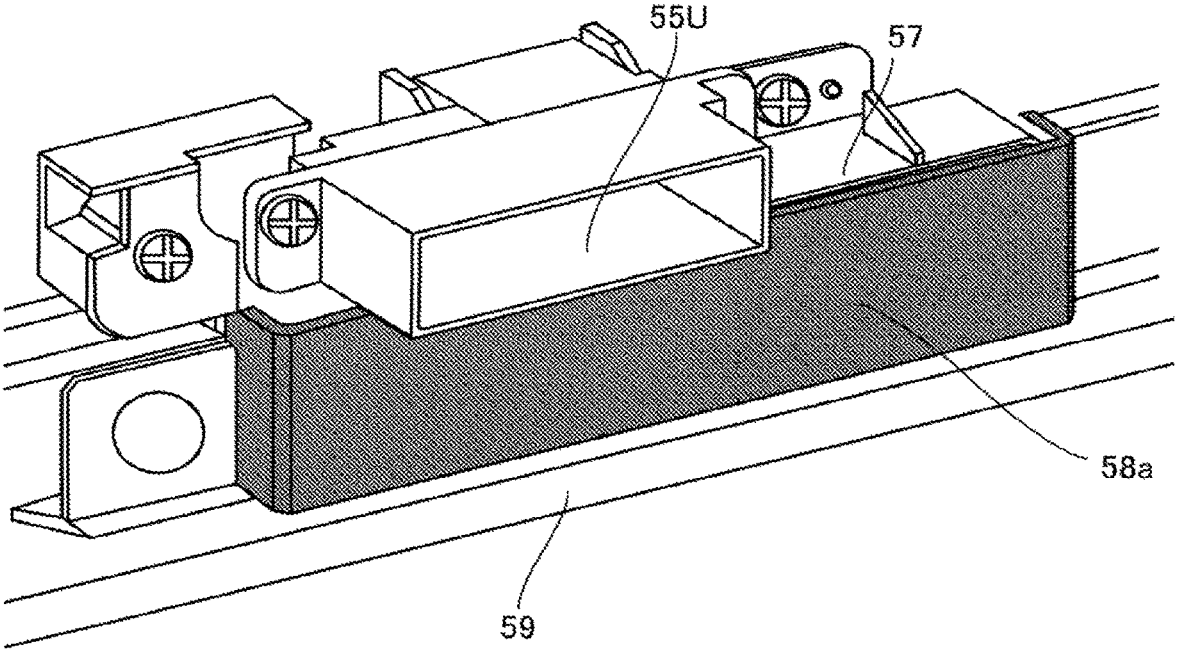
FIGS. 11A and 11B are diagrams illustrating a substrate covering part that covers the relay substrate of the fixing device according to the embodiment.
Figure 11B:
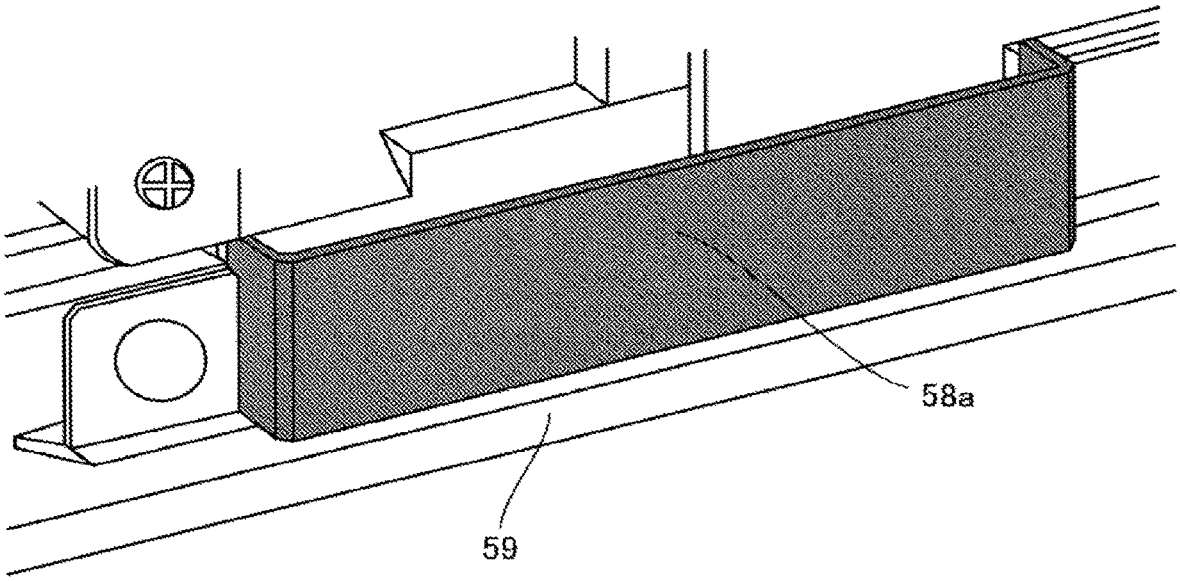

FIGS. 11A and 11B are schematic diagrams illustrating a state in which the relay substrate 56 is covered with the substrate covering member 58*a*. FIG. 11A illustrates a state in which the drawer connector 55U is set, and FIG. 11B schematically illustrates a state in which the drawer connector 55U is not set.

Figure 12:
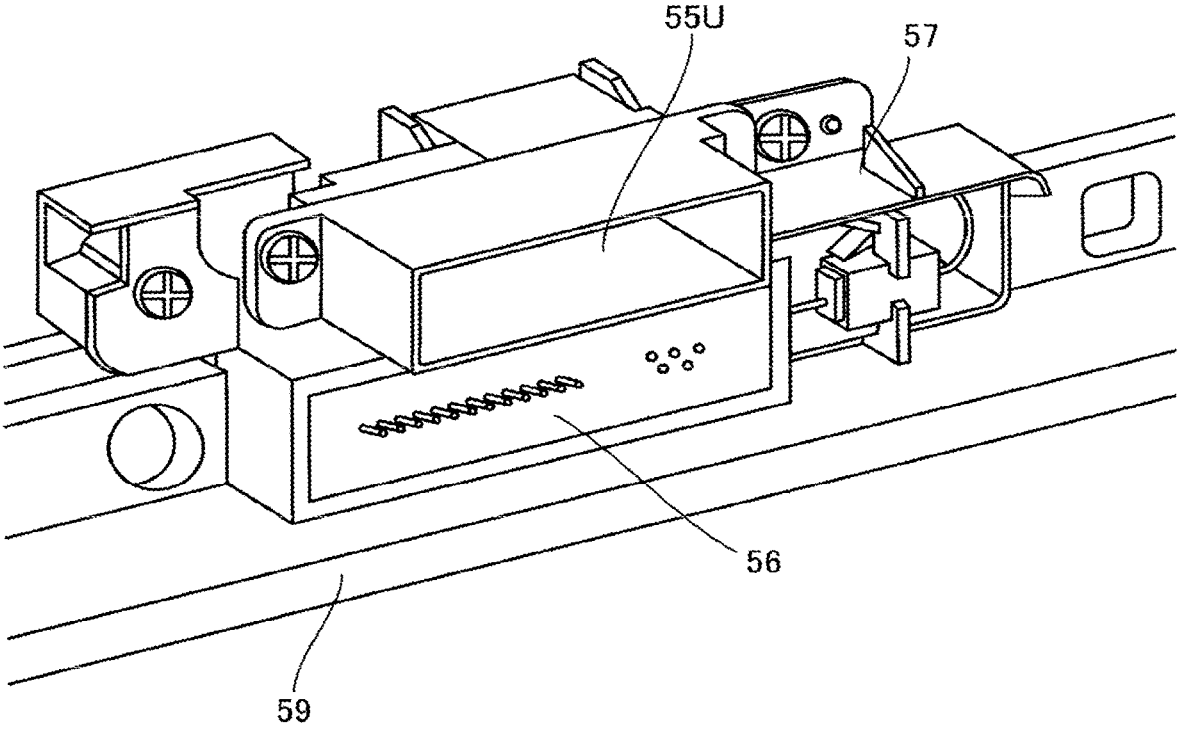
FIG. 12 is a diagram illustrating the relay substrate covered with the substrate covering part illustrated in FIGS. 11A and 11B.

FIG. 12 illustrates a state in which the substrate covering member 58*a* illustrated in FIG. 11A is detached so that the relay substrate 56, which is to be covered with the substrate covering member 58*a*, is exposed.

The drawer connector 55U includes a rectangular opening, and internally includes a terminal plated with gold. On the other hand, a drawer connector 55H (FIG. 4) on the main body side of the image forming device also has a shape corresponding to the rectangular opening, and internally includes a terminal plated with gold.

When the terminal on the drawer connector 55U side on the fixing device side is brought into contact with the terminal on the drawer connector 55H side on the main body side, electric connection is formed.

Figure 2:
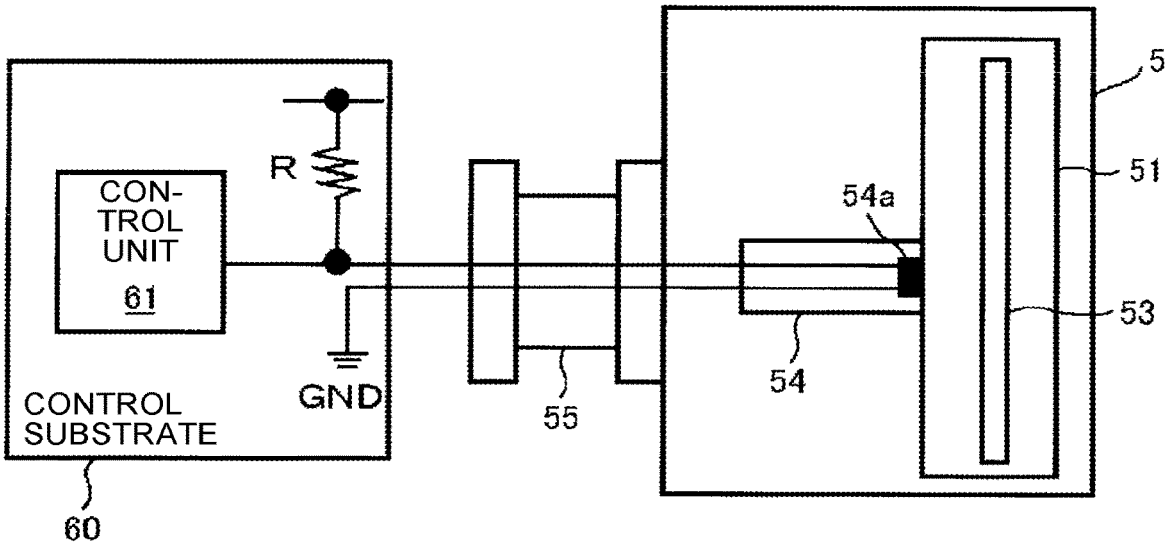
FIG. 2 is a diagram illustrating one example of a temperature detection circuit of a fixing device according to the embodiment.

The fixing device 5 includes a temperature detecting means 54 (FIG. 2). The temperature detecting means 54 (FIG. 2) includes an end part thermistor disposed at an end part of the fixing device 5 in a longitudinal direction, and a central thermistor disposed at a central part. Under the drawer connector 55U, a holding member 57 is fixed to the exterior member 5*a* of the fixing device 5 and the relay substrate 56 is disposed in the holding member 57.

The drawer connector 55U protrudes in a direction orthogonal to a surface of the substrate covering member 58*a* that faces the relay substrate 56 as illustrated in FIG. 11A, and covers at least a part of an upper part (upper end surface) of the substrate covering member 58*a* in a vertical direction. That is to say, even if the upper part of the substrate covering member 58*a* in the vertical direction is open and does not cover the relay substrate 56, the relay substrate 56 is covered with the drawer connector 55U.

From the viewpoint of the workability for wiring and the like, it is preferable that there is a region where the relay substrate 56 is not covered in the upper part of the substrate covering member 58*a* in the vertical direction.

As illustrated in FIG. 9, the relay substrate 56 is preferably disposed between the protruding part 58*b* that is the conveyance guide part of the conveyance guide member (upper guide) 58 and the drawer connector 55U in a planar view in the vertical direction.

Note that the relay substrate 56 is connected to the drawer connector 55U with a harness; therefore, the relay substrate 56 is preferably disposed near the drawer connector 55 from the viewpoint of wiring.

In addition, it is preferable that the size of the conveyance guide member (upper guide) 58 including the substrate covering member 58*a* and the protruding part 58*b* that is the conveyance guide part is small from the viewpoint of the cost of the components and the size reduction of the device.

Although the operation failure due to dew condensation on the relay substrate 56 can be prevented as described above, it is also necessary to prevent the trouble caused by the contact failure at the contact point of the drawer connector 55U.

In this regard, in the fixing device 5 according to the present embodiment, the lead wires that transmit various control signals, each branch into a plurality of lines by pattern wiring on the relay substrate 56 and connected to the drawer connector 55U.

Thus, the reliability of the device can be increased further by causing wiring to include a multiple line (making into a multiple line) and preventing the dew condensation on the relay substrate 56.

A structure including a multiple line is described below.

FIG. 2 is a diagram illustrating one example of a temperature detection circuit of the fixing device according to the embodiment.

The temperature detecting means 54 provided in the fixing device 5 is a temperature detecting means that detects the temperature of the fixing device 5, and includes a thermistor element 54*a* whose resistance value changes depending on the temperature and by the change of the resistance value, detects the temperature of the fixing member 51. Although the thermistor is used as the temperature detecting means 54 here, the temperature detecting means 54 is not limited to the thermistor. To the temperature detecting means 54, current from a control unit 61 of a control substrate 60 flows through the drawer connector (hereinafter, the drawer connector structured by the fixing device side connector 55U and the main body side connector 55H is simply referred to as "drawer connector 55"). In addition, the control unit 61 detects the voltage that changes depending on the resistance change in the thermistor element 54*a* and controls the electric conduction to the heating source 53, thereby controlling the temperature of the fixing member 51.

The drawer connector 55 is formed by a pair of connectors, a male connector and a female connector, and conducts electricity when terminal parts of the respective connectors are in contact at the connector insertion. The terminal for the lead wire of the drawer connector 55 that is expected to be inserted or extracted a number of times is generally formed by plating a base material of copper with nickel, and further plating the surface with gold.

When the gold plating on the surface layer of the terminal at the contact point part of the drawer connector 55 in the temperature detection circuit is separated to expose the nickel plating in the lower layer and the exposed nickel plating is placed under the environment with high temperature and high humidity near the fixing device 5, nickel oxide and an oxide film may be generated. In addition, dust or a foreign matter may enter the contact point part and such dust or foreign matter may cause the contact failure.

If such contact failure at the contact point part occurs and the temperature detection signal is not transmitted properly, the temperature that is higher or lower than the correct detection temperature is detected. If the higher temperature is mistakenly detected, the fixing device 5 is controlled to have a lower temperature than the correct target temperature and the toner image on the recording medium is not fixed properly; thus, the image quality deteriorates. On the other hand, if the lower temperature is mistakenly detected, the fixing device 5 is controlled to have a higher temperature than the correct target temperature; thus, the fixing device 5 deteriorates faster or other problems occur. In the occurrence of such a trouble, the user or service person needs to detach the fixing device 5 once and clean the fixing device 5, and if cleaning the fixing device 5 is not enough to solve the problem, the fixing device 5 needs to be exchanged.

Figure 3:
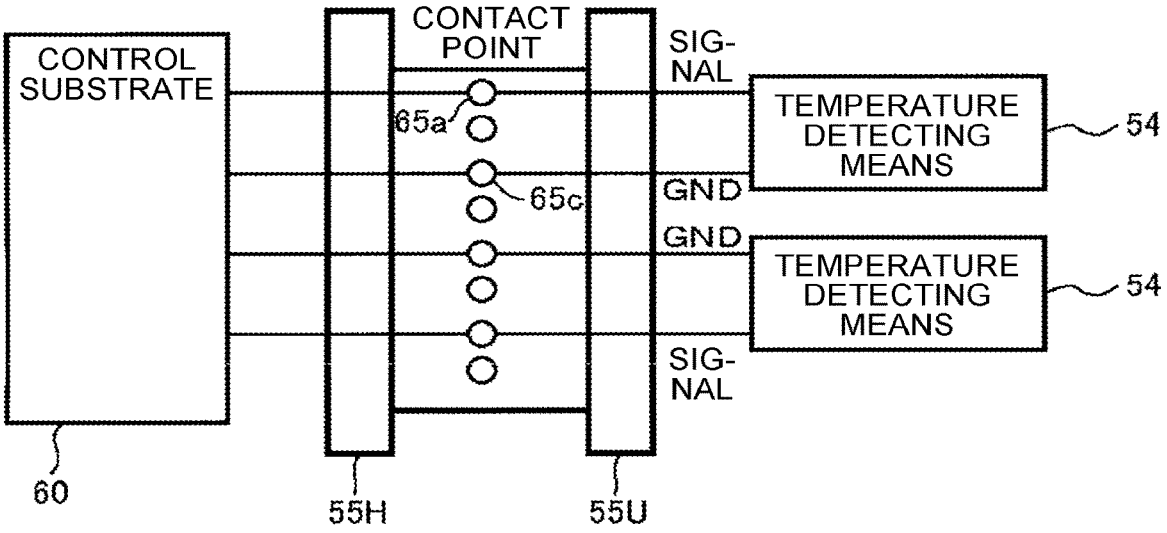
Related Art FIG.3
FIG. 3 is a diagram illustrating a conventional temperature detection circuit that schematically illustrates a contact point of a drawer connector.

FIG. 3 is a diagram illustrating a conventional temperature detection circuit that schematically illustrates the contact point of the drawer connector.

The drawer connector 55 includes the drawer connector (fixing device side connector) 55U and the drawer connector (main body side connector) 55H, and is disposed between the temperature detecting means 54 and the control substrate 60 of the device main body. The fixing device side connector 55U is set in the fixing device 5, and the main body side connector 55H is set in the image forming device main body. In general, the thermistor as the temperature detecting means includes two lead wires, which are separately used as a signal line and a GND line (earth line). The lead wires of the temperature detecting means 54 are connected to the fixing device side connector 55U. The lead has a terminal at an end thereof, and the place where the terminal of the main body side connector 55H and the terminal of the fixing device side connector 55U are in contact corresponds to the contact point. The temperature detection current flows from the signal side of the control substrate 60 to the signal side of the temperature detecting means 54 through a contact point 65*a* of the drawer connector 55, flows in the thermistor element 54*a* (not illustrated in FIG. 3), and flows to the control substrate 60 through another contact point 65*c* of the drawer connector 55 again from the GND side of the temperature detecting means 54.

Here, if the resistance at any contact point (for example, contact point 65*a*) of the drawer connector 55 increases, another resistance is added to the temperature detection circuit and the correct temperature cannot be detected, and in this case, the aforementioned trouble occurs.

Figure 4:
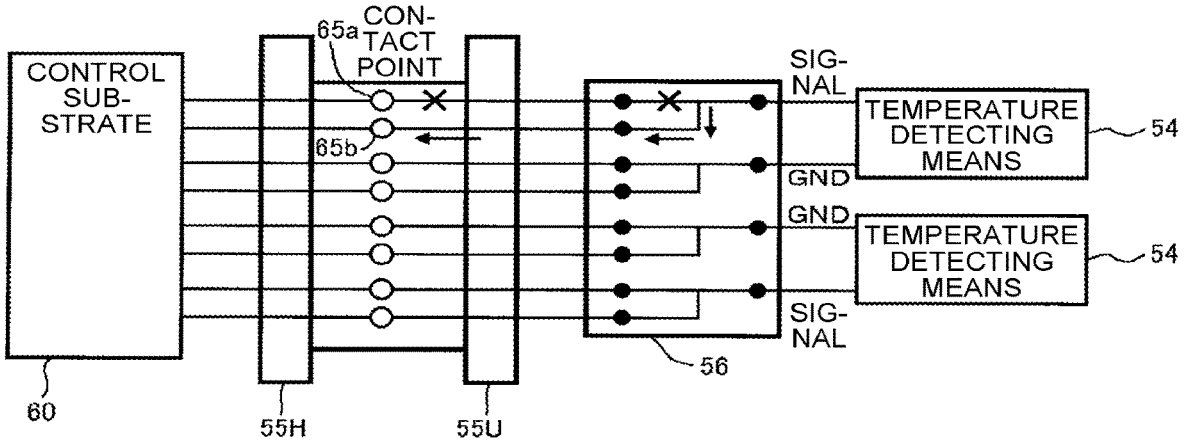
FIG. 4 is a diagram illustrating a temperature detection circuit according to the embodiment of the present invention that schematically illustrates a contact point of the drawer connector.

FIG. 4 is a diagram illustrating the temperature detection circuit according to the embodiment of the present invention that schematically illustrates the contact point of the drawer connector.

This temperature detection circuit is one example of making into a multiple line using the relay substrate 56. Specifically, the relay substrate 56 is disposed between the temperature detecting means 54 and the drawer connector 55. The signal line and the GND line, which are the lead lines from the temperature detecting means 54, are respectively connected to the relay substrate 56 on the signal side and the GND side, and branch into two signal lines and two GND lines (that is, each made into a multiple line) and connected to the control substrate 60 through the drawer connector 55. The lead wire of the temperature detecting means 54 branches into a multiple line by the pattern wiring on the relay substrate 56. By the use of the relay substrate 56, the drawer connector 55 that has been used conventionally and versatilely can be used, and thus, the drawer connector 55 can be obtained at low cost. In the control substrate 60, the signal is transmitted as one signal to the control unit 61 by the pattern wire in the control substrate 60. Alternatively, two lead wires may be returned to one lead wire by using a relay substrate or a relay connector also on the device main body side. One or more temperature detecting means 54 may be provided in the fixing device 5.

As described above, the fixing device 5 according to the present embodiment includes: one or a plurality of temperature detecting means 54 that detect the temperature of the fixing device 5; and the fixing device side connector 55U that transmits the temperature detection signal from the temperature detecting means 54 to the image forming device main body by the contact between the terminal thereof and the terminal of the main body side connector 55H. The lead wires of the temperature detecting means 54 each branch into the plurality of lines in parallel and connected to the fixing device side connector 55U. Thus, even in a case where the contact failure occurs in the contact point of the connector that connects the lead wire of the temperature detecting means 54 of the detachable fixing device 5 to the image forming device main body, the temperature detection signal can be transmitted correctly and the occurrence of the resulting trouble can be prevented.

Figure 5:
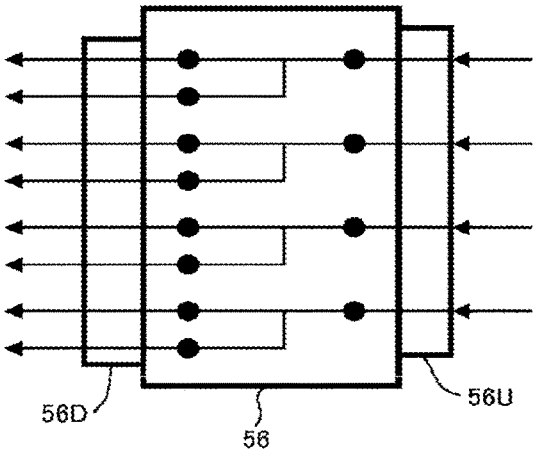
FIG. 5 is a diagram illustrating branching of signal lines on a relay substrate.

Next, the branching of the lead wire in the relay substrate 56 is described with reference to FIG. 5. FIG. 5 is a schematic magnified diagram of the relay substrate 56 illustrated in FIG. 4.

One lead wire from the temperature detecting means 54 is connected to the relay substrate 56 as one lead wire through a relay connector 56U. Each of the signal line and the GND line as the lead wires of the temperature detecting means 54 branches from one line into two lines by the pattern wiring in the relay substrate 56. These lines are each made into a multiple line arranged in parallel to each other. The signal line and the GND line that are each made into a double line are connected to the drawer connector 55 through a relay connector 56D. The relay substrate 56 includes the relay connector 56U and the relay connector 56D. The number of wires may be not just doubled but also tripled or more.

With reference to FIG. 4 again, description is made of a case in which the resistance at one contact point of the drawer connector 55 increases.

In the case where the resistance at one contact point 65*a* illustrated in FIG. 4 increases, the current flows to the line with lower resistance in a manner similar to FIG. 3 since the signal lines are each made into a multiple line arranged in parallel. That is to say, current flows to the control substrate 60 through another contact point 65*b* that is arranged in parallel as indicated by an arrow in the drawing. The current at this time flows with the same value as that when the resistance does not increase, as already known by Ohm's law, and thus, the temperature detection signal is transmitted correctly. As a result, the contact point 65*a* where the resistance increases becomes unnecessary in the temperature detection circuit, and the fixing device 5 operates normally without any trouble.

Figure 6:
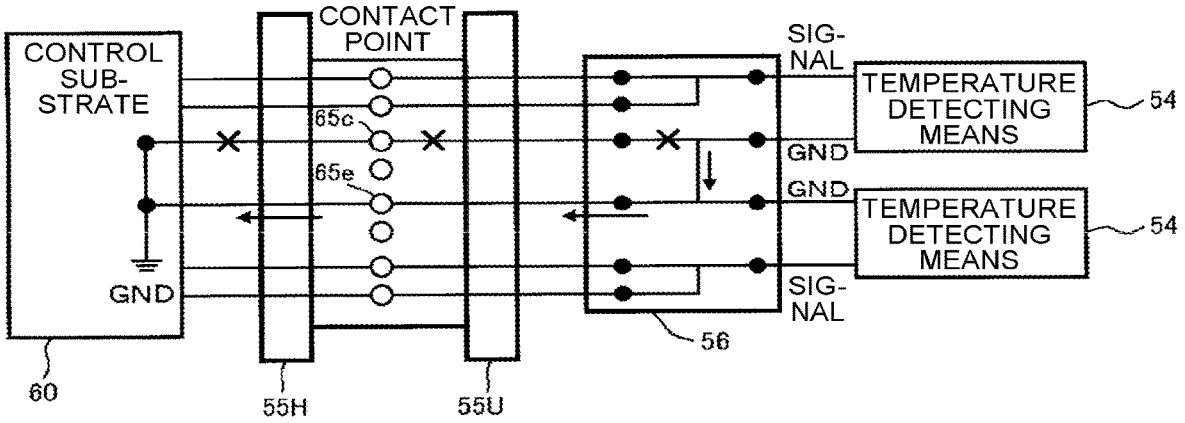
FIG. 6 is a diagram illustrating a temperature detection circuit according to another embodiment of the present invention that schematically illustrates a contact point of a drawer connector.

FIG. 6 is a diagram illustrating the temperature detection circuit according to another embodiment of the present invention that schematically illustrates the contact point of the drawer connector 55.

In the present embodiment, the relay substrate 56 is disposed between the temperature detecting means 54 and the drawer connector 55, and the signal line and the GND line are provided independently of each other in the temperature detecting means 54. The signal lines from the respective temperature detecting means 54 are connected to the relay substrate 56, where each signal line branches into two signal lines (that is to say, each made into a multiple line). The signal lines are connected to the control substrate 60 through the drawer connector 55. On the other hand, the GND lines from the temperature detecting means 54 are connected to each other by the pattern wires on the relay substrate 56. Although the signal lines transmit the signals of the detected temperature, the GND wires are common as a reference. In this temperature detection circuit, the GND lines are usable commonly; therefore, the GND lines can be connected in parallel to each other when passing the drawer connector 55. In the occurrence of abnormality at one contact point, this parallel connection enables the current to flow to the normal contact point in a manner similar to the case of the signal line, so that the temperature can be detected correctly. For example, in the present embodiment, in the case where the resistance increases at the contact point 65*c*, current flows to the control substrate 60 through another contact point 65*e*. Thus, the occurrence of a trouble due to the abnormality in the contact point can be prevented and the reliability can be increased. By using the relay substrate 56, the contact point of the GND line can be selected freely. The number of contact points of the GND lines can be increased or decreased by the restriction of the number of temperature detecting means and the number of signal lines of the drawer connector 55. The signal is transmitted to the drawer connector 55 using the GND lines of the temperature detection circuit commonly and thus, the aforementioned effect can be obtained without increasing the number of usable signal lines on the drawer connector 55. In addition, since the number of lines is not increased, the enlargement of the device can be prevented and the cost increase can be suppressed. By the use of the relay substrate 56, the drawer connector 55 that has been used conventionally and versatilely can be used and thus, the drawer connector 55 can be obtained at low cost.

Figure 7:
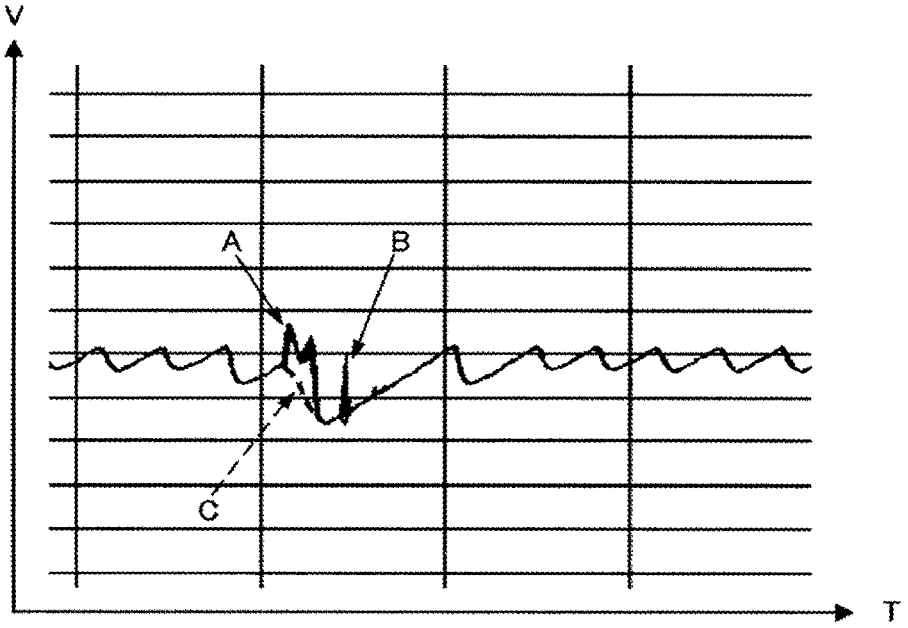
FIG. 7 is a diagram illustrating voltage change depending on temperature change of a fixing member.

FIG. 7 is a diagram illustrating the voltage change depending on the temperature change of the fixing member 51.

The control unit 61 captures the voltage value as the temperature detection signal, controls the electric conduction of the heating source 53, and controls the fixing member 51 to have constant temperature; thus, as illustrated in the drawing, the voltage value synchronizing with the temperature of the fixing member 51 is usually controlled to be the constant value. However, in the case where the resistance at the contact point part increases, the temporary voltage deviation (arrows A and B in the drawing) as illustrated in FIG. 7 occurs. The voltage value when the terminal has normal resistance is indicated by an arrow C in the drawing.

The temporary variation of the temperature detection signal causes the target temperature to deviate from the correct value, resulting in that the entire waveform that has transited with a constant amplitude is also disordered. The behavior at the contact point part when the contact failure due to the nickel oxide occurs is very instable and the contact resistance changes suddenly or the resistance becomes intermediate. In most cases, however, the resistance increase does not last and due to small vibration or attachment or detachment of the fixing device, the state returns to a normal state. In the example in FIG. 7, the voltage waveform becomes normal after two or three resistance increases, and thus, the temperature detection waveform immediately returns to the waveform corresponding to the constant temperature.

In this manner, the resistance in the occurrence of the contact failure due to the nickel oxide does not continuously deviate in most cases and thus, by arranging the contact points in parallel, it is very likely that the other normal contact points can be used and accordingly, the temperature detection signal can be transmitted correctly. The probability that the trouble occurs in the image forming device due to the increase in resistance at the contact point can be drastically reduced.

On the contrary, in the case where the resistance at the contact point continuously increases, the resistance at the plural contact points increases at the same time and in such a case, the effect of the plural contact points cannot be obtained.

Figure 8:
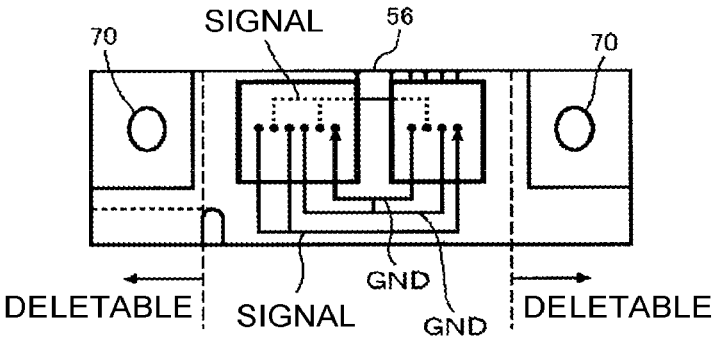
FIG. 8 is a schematic structure diagram of the relay substrate.

FIG. 8 is a schematic structure diagram of the relay substrate 56.

In the relay substrate 56 illustrated in FIG. 8, the signal lines each branch into two signal lines (that is, each made into a multiple line) in a manner similar to the relay substrate 56 illustrated in FIG. 6. On the other hand, the GND lines are connected to each other.

Note that the relay substrate 56 is held by the holding member 57 as illustrated in FIG. 12 described above. Since the screw attachment shape is unnecessary, the part including a screw hole 70 of the relay substrate 56 in FIG. 8 can be deleted and accordingly, the size of the relay substrate 56 can be reduced.

Heating Device

The heating device according to the present invention includes a heating member including the heating source 53 internally, the pressing member 52 that forms the nip part N by pressing against the heating member, the relay substrate 56, and the substrate covering member 58*a* that covers the relay substrate 56. The substrate covering member 58*a* includes the protruding part 58 that extends in the direction toward the pressing member 52.

In this mode, the heating member functions as the fixing member 51 and the other structure is similar to that of the aforementioned fixing device 5 and image forming device.

In this mode, the heating member functions as the fixing member and the other structure is similar to that of the aforementioned fixing device and image forming device.

FIG. 9 is a cross-sectional view illustrating the main part structure of the fixing device 5 including the heating device according to the present invention.

The fixing device 5 according to the present embodiment includes the fixing member 51 as the heating member including the heating source 53 internally, the pressing member 52 that forms the nip part N by pressing against the fixing member 51 as the heating member, the relay substrate 56, and the substrate covering member 58*a* that covers the relay substrate 56. The substrate covering member 58*a* includes the protruding part 58*b* that extends in the direction toward the pressing member 52.

The protruding part 58*b* is integrated with the substrate covering member 58*a* to form the upper guide (conveyance guide member) 58. The conveyance guide member 58 conveys an object to be heated by the heating device to the nip part N.

When the protruding part 58*b* is heated by the heat radiated from the fixing member 51 as the heating member, the temperature of the substrate covering member 58*a* forming the conveyance guide member 58 that is the integrated member also increases. Thus, the temperature around the relay substrate 56 increases and accordingly, the dew condensation on the surface of the relay substrate 56 can be prevented and the occurrence of a trouble due to the adhesion of dew can be prevented.

In a mode in which the heating member is set in the electrophotography image forming device illustrated in FIG. 1, the heating member corresponds to the fixing member 51 that heats the toner image to fix the toner image on the recording medium S; however, the heating member is not limited to the fixing member 51.

In addition to being usable for the electrophotography image forming device, the heating device according to the present invention can also be used for an inkjet image forming device including a drying device, for example. In this mode, the heating member corresponds to a member that dries the ink applied on the recording medium S.

In addition, the heating device according to the present invention can be used for a thermocompression device or the like, in addition to the fixing device and the image forming device described above.

The thermocompression device may be any device that thermally compresses an object without particular limitation, examples thereof include a laminator that thermally compresses a covering member (for example, film) on a surface of a sheet of a recording medium or the like, a heat-sealer that thermally compresses a seal part of a package material, and the like.

An embodiment can provide the fixing device in which the adhesion of dew on the relay substrate can be prevented and the occurrence of the trouble in the signal transmission can be prevented.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A fixing device configured to be detachably attached to an image forming device main body, comprising:

a fixing member configured to heat a toner image so as to fix the toner image on a recording medium;

a heating source configured to heat the fixing member;

a pressing member configured to press against the fixing member to form a nip part;

a conveyance guide member configured to guide the recording medium to the nip part;

an exterior member housing at least the fixing member and the pressing member;

a relay substrate; and a substrate covering member covering the relay substrate, wherein the substrate covering member extends from and is integrated with the conveyance guide member.

2. The fixing device according to claim 1, wherein the exterior member includes a drawer connector configured to transmit a signal to the image forming device main body by contact between terminals, and the relay substrate is connected to the drawer connector through a lead wire configured to transmit the signal.

3. The fixing device according to claim 2, wherein the lead wire branches into a plurality of lines by pattern wiring on the relay substrate, and is connected to the drawer connector.

4. The fixing device according to claim 2, wherein the drawer connector protrudes in a direction orthogonal to a surface of the substrate covering member, the surface facing the relay substrate, and covers at least a part of an end part of the substrate covering member.

5. The fixing device according to claim 2, wherein the relay substrate is disposed between the drawer connector and a conveyance guide part of the conveyance guide member in a planar view in a vertical direction.

6. The fixing device according to claim 1, wherein the conveyance guide member is formed of at least one of a material with higher thermal conductivity and a material with smaller specific heat than the exterior member, and is configured to be heated by heat radiated from the fixing member.

7. An image forming device comprising the fixing device according to claim 1.

8. A fixing device configured to be detachably attached to an image forming device main body, comprising:

a fixing member configured to heat a toner image so as to fix the toner image on a recording medium;

a heating source configured to heat the fixing member;

a pressing member configured to press against the fixing member to form a nip part;

a relay substrate; and a substrate covering member covering the relay substrate, wherein the substrate covering member includes a protruding part extending in a direction toward the pressing member.

9. An image forming device comprising the fixing device according to claim 8.

10. A heating device comprising:

a heating member including a heating source internally;

a pressing member configured to press against the heating member to form a nip part;

a relay substrate; and a substrate covering member covering the relay substrate, wherein the substrate covering member includes a protruding part extending in a direction toward the pressing member.

11. A fixing device comprising the heating device according to claim 10, wherein the heating member comprises a fixing member.

12. An image forming device comprising the fixing device according to claim 11.

* * * * *